United States Patent [19]

Fantuzzo

[11] 3,974,554

[45] Aug. 17, 1976

[54] QUADRANGULAR TRIHELICOID GRAVURE ROLL

[75] Inventor: Joseph Fantuzzo, Webster, N.Y.

[73] Assignee: Xerox Corporation, Stamford, Conn.

[22] Filed: May 16, 1975

[21] Appl. No.: 578,310

[52] U.S. Cl. ..... 29/121.4; 118/637

[51] Int. Cl.[2] ..... B21B 27/02; B21B 31/08; B05B 5/02

[58] Field of Search ..... 118/637, DIG. 23; 355/10; 427/15; 29/121

[56] References Cited

UNITED STATES PATENTS

| | | | |
|---|---|---|---|
| 3,276,896 | 10/1966 | Fisher | 118/637 |
| 3,424,126 | 1/1969 | Mahoney | 118/DIG. 23 |
| 3,472,695 | 10/1964 | Kaufer et al. | 118/637 |
| 3,667,428 | 6/1972 | Smith | 355/10 |
| 3,696,783 | 10/1972 | Fantuzzo | 118/637 |
| 3,712,728 | 1/1973 | Whittaker | 355/10 |
| 3,762,365 | 10/1973 | Herzog | 118/212 |
| 3,830,199 | 8/1974 | Saito et al. | 118/637 |

*Primary Examiner*—Ronald Feldbaum
*Attorney, Agent, or Firm*—James J. Ralabate; Donald C. Kolasch; Ernest F. Chapman

[57] ABSTRACT

An article of manufacture for use in the fluid development of electrostatic images is disclosed. The article is characterized by a substantially cylindrical roll which has at least one volute groove partitioned into a plurality of cells for carrying a quantity of development fluid. The partitions prevent a doctor blade, applicable to the cylindrical roll from penetrating too deeply into the cells and thereby prevent substantial quantities of development fluid from being removed from the cells during doctoring.

9 Claims, 5 Drawing Figures

FIG. 1
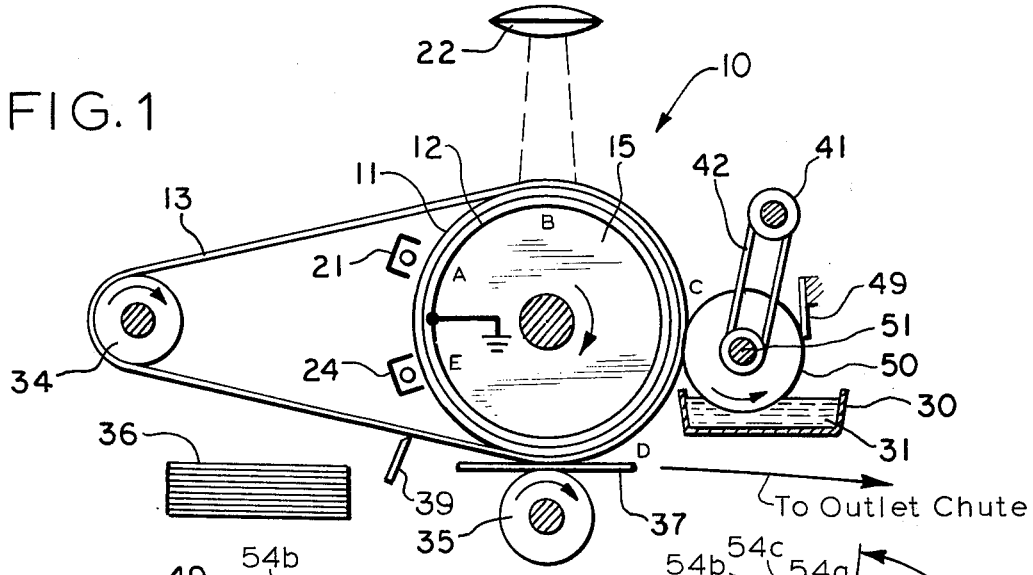
FIG. 2
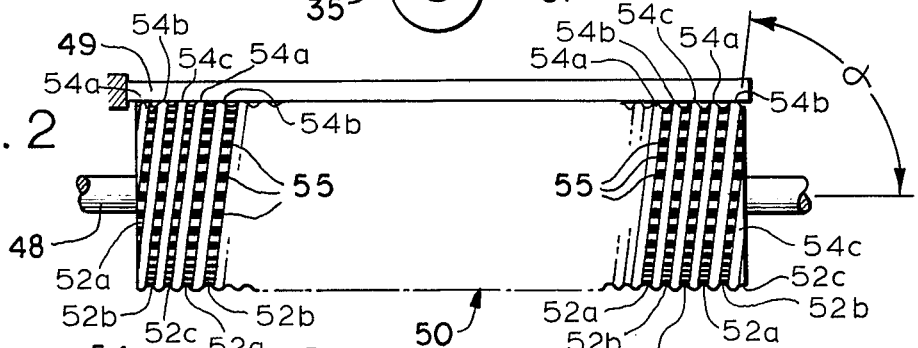
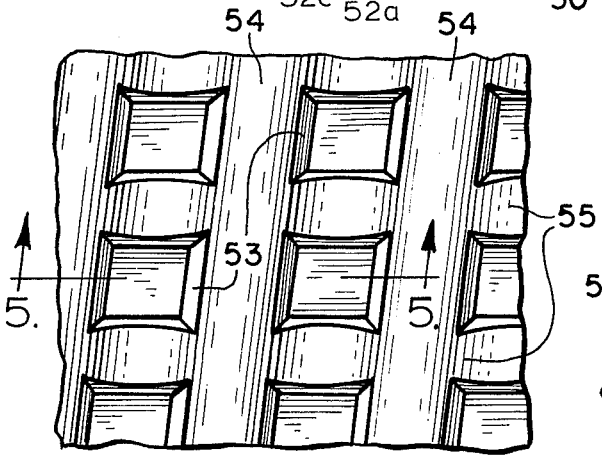
FIG. 3
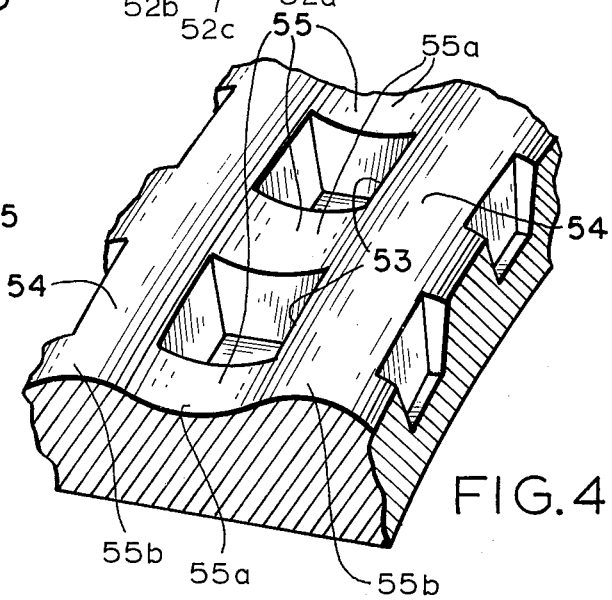
FIG. 4
FIG. 5
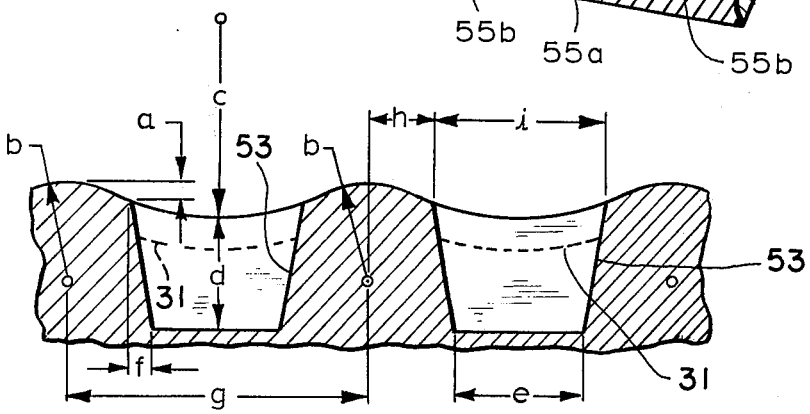

QUADRANGULAR TRIHELICOID GRAVURE ROLL

BACKGROUND OF THE INVENTION

This invention generally relates to the reproduction of selected images by the electrostatic attraction of development fluid such as liquid ink onto a receiving medium. More particularly, the invention relates to an improved article of manufacture, sometimes referred to herein as a gravure roll, used for transferring predetermined quantities of development fluid from a source to the receiving medium.

Fluid development of electrostatic images is not new, an early system embodying such a concept being disclosed in U.S. Pat. No. 3,048,043 issued to R. W. Gundlach on Apr. 2, 1963 and assigned to the instant assignee. Though specific prior art fluid development systems vary, a typical apparatus may include a rotatable drum having a photoconducting surface and an electrically conductive substrate. In general, latent electrostatic images are formed on the photoconducting surface by uniformly charging the surface thereof, as by a corona discharge device followed by exposure to light in the desired image pattern and development by liquid developers. Development may be carried out on the photoconducting surface itself or on other receiving means. The receiving means may be an interposer member or any other suitable means moved between a roller and the rotatable drum, thereby contacting a portion of the photoconducting surface at all times. The developed image pattern may be transferred from the photoconducting surface or the receiving means to a suitable support surface, such as paper, metal, polymer film and the like.

In fluid development systems having a receiving means, a portion of the photoconducting surface, not then rotated into contact with the receiving means such as the transparent interposer, is uniformly electrostatically charged by any suitable means. The charged portion of the photoconducting surface is then subjected to a light and shadow representation of the selected image. Accordingly, the original charge applied to the photoconducting surface, upon receipt of the light and shadow representation, assumes a pattern corresponding to the image to be developed, said pattern subsequently being capable of development on the receiving means (interposer).

Electrostatic imaging systems of the prior art further include a source of development fluid, and patterned means adapted to receive development fluid from said source. The particular patterns formed in the patterned means may vary, though, as explained in U.S. Pat. No. 3,801,315 issued to Robert W. Gundlach, et al. on Apr. 2, 1974 and assigned to the instant assignee, one specially well-suited pattern is a triangular-helix. As the name implies, this pattern comprises three parallel volute grooves disposed in the surface of a cylinder. To many of those skilled in the art, such a cylinder is sometimes referred to as a trihelicoid gravure roll, and that terminology is followed herein.

Upon receipt of development fluid, a doctor blade is conventionally applied to the gravure roll in an effort to remove excess fluid which would otherwise interfere with the accurate reproduction of the selected image. The doctored, fluid-carrying gravure roll is then typically rotated into facing relationship with the photoconducting surface of the rotatable drum, or in the case where there is an interposing surface at a point where the interposer is in contact with the photoconducting surface. Development fluid is then electrostatically attracted to the portion of the interposer overlying the charged portion of the photoconducting surface or to the charged portion of the photoconducting surface itself.

After development, the photoconducting surface or the interposer is moved into contact with a copying medium such as a sheet of copy paper. A pressure roller, adapted to urge the copy paper against the interposer or photoconducting surface, facilitates passage of development fluid from the interposer or photoconducting surface to the paper. Since the development fluid on the interposer or photoconducting surface is typically in the form of the selected image, that image is transferred to the paper. After development, the photoconducting surface is discharged through the conductive substrate, thereby eliminating any residual electrostatic charges remaining on the photoconducting surface. At substantially the same time, excess development fluid on the interposer or the photoconducting surface is removed by means such as a doctor blade, thereby readying the apparatus for the subsequent development of other selected images.

Though fluid development systems of the type described have been used to reproduce selected images, they are subject to numerous drawbacks and deficiencies. For example, it is difficult to transfer accurate quantities of development fluid to the gravure roll for subsequent deposition onto the photoconducting surface or the receiving means such as a transparent interposer. As a result, insufficient amounts of fluid are sometimes attracted to the surface to be developed, thereby preventing portions of the selected image from being fully developed. Alternatively, too much fluid is often attracted to the surface to be developed, causing an undesirable blotching effect. Accordingly, it is a primary object of this invention to provide means for assuring that the proper amount of development fluid is passed from the gravure roll.

Another problem frequently associated with fluid development systems of the type described relates to the doctoring of excess ink from the gravure. More particularly, the doctor blade frequently used in conventional fluid development systems must be applied with sufficient force to insure removal of all excess fluid from the gravure roll, particularly the high points or lands thereof. If such exesss fluid is not removed, blotching will inevitably occur.

When the doctor blade is forcefully applied to the gravure roll, however, it is often urged into the trihelicoid grooves, thereby withdrawing development fluid therefrom. As a result, there may be too little fluid remaining in the grooves for proper attraction onto the receiving medium. In addition, the withhdrawal of the fluid from the grooves in the gravure roll alters the distance between the receiving medium and the development fluid. If this distance becomes too great, the electrostatic forces may be insufficient to properly draw the fluid to the recording medium. On the other hand, if the distance is too small, development fluid could be attracted to areas on the recording medium where fluid should not be deposited. Accordingly, it is a further object of the invention to provide an improved fluid development system wherein the distance between the receiving medium and the development fluid carried by the gravure roll is not appreciably changed upon doctoring the gravure roll.

SUMMARY OF THE INVENTION

The various objects of the invention, along with numerous features and advantages, are achieved in an article of manufacture for use in the fluid development of electrostatic images. The article of manufacture is characterized by a substantially cylindrical roll which has at least one volute groove and which may further have partitions intersecting the groove, defining a plurality of cells for carrying a quantity of development fluid. The partitions serve to prevent doctoring means, applicable to the cylindrical roll, from penetrating too deeply into the cells, and thereby assure that substantial quantities of development fluid are not removed from the cells during doctoring.

BRIEF DESCRIPTION OF THE DRAWINGS

A better understanding of the invention summarized above can be obtained upon reading the following detailed description in conjunction with the accompanying drawings in which:

FIG. 1 is a schematic view of an apparatus for the fluid development of electrostatic images embodying the article of the invention;

FIG. 2 is a front view, greatly enlarged, of the article shown in FIG. 1;

FIG. 3 is an enlarged top view of a portion of the article shown in FIG. 2;

FIG. 4 is an enlarged perspective view of a portion of the article shown in FIG. 2; and FIG. 5 is an enlarged sectional view, taken along lines 5—5 of FIG. 3.

DETAILED DESCRIPTION OF AN EXEMPLARY EMBODIMENT

As explained hereinbefore, this invention relates most particularly to an improved gravure roll used for transferring quantities of development fluid to a receiving medium. In this exemplary embodiment, the gravure roll has at least one and probably three volute grooves disposed in its surface. Disposed between each volute turn of each groove is a parallel land which must be doctored prior to transfer of the development fluid to the receiving medium in order to prevent blotching, or other undesirable effects. Intersecting each groove and each land is a plurality of partitions defining cells adapted to carry development fluid.

In operation, the improved gravure roll is adapted for continuous rotation above a reservoir, inking train, or some other source of development fluid so that liquid developer is supplied to the gravure roll. This, in turn, allows a number of the cells of the roll to carry a quantity of development fluid. The gravure roll is then rotated into contact with a doctor blade which removes excess development fluid from the lands of the gravure roll prior to the transfer of development fluid to the photoconducting surface or receiving medium. More particularly, the doctor blade is forcefully applied to the gravure, thereby wiping the lands clean. Significantly, the partitions which intersect each groove and each land, prevent the doctor blade from being urged into the fluid-carrying cells, thereby assuring that substantial quantities of development fluid are not removed from the cells during doctoring.

By providing a gravure roll in which the level of development fluid carried in the cells in not appreciably altered during doctoring, the gravure roll can be precisioned relative to the medium so that the distance between the fluid receiving medium and the fluid to be attracted thereto remains constant for each rotation of the gravure roll. This constant distance assures that, for a predetermined electrostatic charge, a sufficient attractive force is produced to properly draw the development fluid from the cells to the photoconducting surface or other receiving medium. This, in turn, assures that faithful reproductions of the selected image will result.

Referring now to the drawings, and in particular to FIG. 1, a schematic view of a fluid development apparatus 10 is shown. Since it is intended that the article of the invention will be used in such an apparatus, it is believed that a general understanding of the operation of apparatus 10 would be helpful. Apparatus 10 includes a rotatable drum 15 having a conductive substrate 12 connected to a point of low potential such as ground. Surrounding substrate 12 is a photoconductive surface 11. A fluid receiving medium which may be in the form of a transparent interposer 13 is belted around a portion of drum 15 and a roller 34, whereby, interposer 13 overlies a portion, but not all, of photoconductive surface 11.

In the operation of fluid development apparatus 10, a portion of photoconductive surface 11 on drum 15 is subjected to a predetermined electrostatic charge at point A by means such as a corona discharge device 21. Device 21 uniformly charges the surface to a desired polarity in a manner well known in the art. Drum 15 is then rotated in a clockwise direction until the charged portion of photoconductive surface 11 reaches point B. At point B, optical means 22 apply a light and shadow representation of a selected image, through interposer 13, to that portion of the photoconductive surface charged by device 21. The charged portion of photoconductive surface 11 is thus discharged through substrate 12 at points struck by the lighted portion of the light and shadow representation emanating from optical means 22. As a result, the original charge on photoconductive surface 11 assumes a pattern corresponding to the image to be developed.

Drum 15 is then rotated to point C, where development fluid 31, originally stored in a reservoir 30 and carried by a gravure roll 50, is attracted by the charged pattern on photoconductive surface 11 underlying interposer 13. More particularly, as shown in FIGS. 2–5, gravure roll 50 has a plurality of volute grooves 52 separated by corresponding lands 54. Partitions 55, intersecting grooves 52 and lands 54, define a plurality of cells 53 adapted to carry development fluid 31. Though, as shown in this exemplary embodiment, cells 53 are adapted to carry discrete quantities of fluid 31, partitions 55 need not necessarily define cells which are segregated from one another. For example, partitions 55 may further permit communication between cells 53 by which development fluid 31 can pass from one of cells 53 to another.

Still referring to FIG. 1, gravure roll 50 is disposed above reservoir 30 so that the lowermost cells 53 are submerged therein. Thus, as gravure roll 50 is rotated, development fluid 31 is captured in said cells. Gravure roll 50 is also precisioned relative to interposer 13 so that the distance between the interposer and those cells facing the interposer at any given time remains substantially constant. As explained hereinbefore, the gravure roll is fabricated so that no appreciable amounts of development fluid 31 are removed from cells 53 during doctoring. Thus, the predetermined charge on photoconductive surface 11 will be sufficient to properly attract development fluid from cells 53 to interposer 13 when the fluid-carrying cells of gravure roll 50 are rotated into facing relationship with the interposer.

Prior to the rotation of the fluid-carrying cells of gravure roll 50 into facing relationship with interposer 13, excess development fluid is removed from lands 54 by means such as a doctor blade 49. Doctor blade 49 can be fabricated from a variety of materials, though in this exemplary embodiment 60-durometer urethane is utilized. After doctoring, the development fluid carried in cells 53 is attracted to interposer 13 in accordance with the charged pattern on the underlying photoconductive surface 11. Interposer 13 thus carries development fluid in a pattern corresponding to that of the selected image.

The rotation of gravure roll 50 is achieved by mechanical means 60 which include a gear 71 driven by any suitable means (not shown). A drive belt 62, cooperating with gear 61 and fastened around center hub 51 of gravure roll 50, causes the gravure roll to rotate in the direction of the accompanying arrow shown in FIG. 1.

After development fluid has been transferred from cells 53 of gravure roll 50 to interposer 13, drum 15 is rotated to point D. At point D a pressure roller 35 urges a sheet of copy paper 37, passed from a stack 36, into contact with the fluid-carrying interposer 13. As a result, the fluid pattern on interposer 13, which corresponds to the selected image, is transferred to copy paper 37. The developed image on copy paper 37 is then passed to an outlet chute where it can be manually retrieved. After development of the selected image, excess development fluid is removed from interposer 13 by a doctor blade 39, and drum 15 is rotated to point E. At point E, photoconductive surface 11 is discharged by means 24 which may, for example, pass light through substrate 12, thereby removing any residual charges remaining on the photoconductive surface. Apparatus 10 is thus readied for the subsequent development of additional selected images.

Referring now to FIGS. 2–5, a more detailed view of gravure roll 50 is shown. More particularly, in this exemplary embodiment, the surface of gravure roll 50 is seen to have three parallel volute grooves 52*a*, 52*b* and 52*c*, each groove being separated from an adjacent groove by one of three parallel, volute, convex lands 54*a*, 54*b* and 54*c*, respectively. Accordingly, as explained hereinbefore, the surface of gravure roll 50 is in the form of a trihelicoid, though this arrangement should not be construed as limitative. As shown most clearly in FIG. 2, grooves 52*a*, 52*b* and 52*c*, and lands 54*a*, 54*b* and 54*c* are biased relative to the axis of rotation 48 of gravure roll 5 by an angle which, in this exemplary embodiment, is about 80°–85°.

Extending transversely relative to grooves 52 and lands 54, and intersecting the same at substantially right angles, are a plurality of partitions 55. As shown best in FIGS. 3 and 4, partitions 55 are of a concave configuration in the spaces 55*a* between lands 54, and are of a convex configuration at the spaces 55*b* in which they intersect lands 54. Partitions 55, upon intersection with grooves 52, define a plurality of cells 53 which are shown in FIG. 5, and which serve to carry development fluid 31. Though in this exemplary embodiment, cells 53 have a quadrangular cross-section, and are segregated from one another by partitions 55 and lands 54, communication between cells 53 could be provided without departing from the invention.

In this preferred embodiment, grooves 53 are narrower at the bottom than at the top. As a result, the cells 53 defined by partitions 55 are in the shape of an inverted truncated pyramid as shown in FIG. 5. Also shown in FIG. 5 are letters *a–i* representing the various dimensions of gravure roll 50. These dimensions are approximated in the table below.

TABLE

| | | | |
|---|---|---|---|
| *a* | 5–10 microns | *f* | 10 microns |
| *b*(radius) | 40 microns | *g* | 127 microns |
| *c*(radius) | 110 microns | *h* | 26 microns |
| *d* | 70 microns | *i* | 75 microns |
| *e* | 55 microns | | |

Gravure roll 50 can be made by any suitable process such as roto-gravuring or spin-casting, and can be fabricated from any suitable material, though a durable metal, such as steel, is preferred. In use in fluid development apparatus, such as that illustrated herein in FIG. 1, development fluid 31 becomes captured in cells 53 upon rotation of gravure roll 50 through reservoir 30. Doctor blade 49 is then forcefully urged against the gravure to wipe lands 54 clean of excess development fluid. Partitions 55, however, prevent doctor blade 49 from dipping into cells 53, and thus prevent development fluid from being removed from cells 53 during doctoring. When the fluid-carrying pockets of gravure roll 50 are subsequently rotated into facing relationship with interposer 13, the predetermined electrostatic charge on the underlying photoconductive surface 11 will be sufficient to attract the proper amount of development fluid from cells 53 to interposer 13. As a result, a faithful reproduction of the selected image can be produced on copy paper 37.

Though the exemplary embodiment herein disclosed is preferred, it will be apparent to those skilled in the art that many modifications and refinements can be made without parting from the true scope of the invention. Accordingly, all such modifications and refinements are intended to be covered by the appended claims.

I claim:

1. An article of manufacture adapted for use in the fluid development of electrostatic images characterized by a substantially cylindrical roll having at least one volute groove and one convex, volute land extending parallel to said groove, and means intersecting said groove defining a plurality of cells for carrying a quantity of development fluid, said cells being located within said volute groove and further defined by concave partitions extending transversely to said land.

2. The article of manufacture defined in claim 1 wherein said cells are of quadrangular cross-section, and are defined by concave partitions in said groove extending transversely to said land.

3. The article of manufacture defined in claim 2 wherein said cells are in the shape of an inverted, truncated pyramid.

4. The article of manufacture defined in claim 1 wherein said cylindrical roll is characterized by three parallel, volute grooves.

5. An article of manufacture adapted for use in the fluid development of electrostatic images characterized by a substantially cylindrical roll having three parallel, volute grooves and means defining a plurality of quadrangular cells within said volute grooves for carrying discrete quantities of development fluid; each turn of any of said volute grooves being separated from an adjacent turn by a convex, volute land extending parallel to said grooves; and each of said quadrangualr cells being defined by concave partitions extending transversely to said land.

6. The article of manufacture defined in claim 5 wherein said cells are in the shape of an inverted, truncated pyramid.

7. An article of manufacture comprising a substantially clyindrical roll having at least one volute groove adapted to carry a quantity of development fluid; a volute land disposed between each of said grooves extending parallel thereto and adapted to be contacted by means for doctoring said land; means within said volute groove and extending substantially transversely to said volute groove, for preventing said doctoring means from removing substantial quantities of development fluid from said groove when said land is doctored.

8. The article of manufacture defined in claim 1 wherein said cylindrical roll is characterized by three parallel, volute grooves, and is further characterized by a volute land disposed between each of said grooves, and extending parallel thereto.

9. The article of manufacture defined in claim 7 wherein said means within said volute groove and extending substantially transversely to said volute groove comprise a plurality of partitions located below said lands defining a plurality of cells.

* * * * *